US005621936A

United States Patent [19]

Penaligon et al.

[11] Patent Number: 5,621,936

[45] Date of Patent: Apr. 22, 1997

[54] MULTI-PURPOSE HAND TOOL

[76] Inventors: Janet L. Penaligon, 5401 Beach Rd.; Jerry L. Smith, 5690 W. Rowland, both of Littleton, Colo. 80123

[21] Appl. No.: 315,860

[22] Filed: Sep. 30, 1994

[51] Int. Cl.[6] ..... B25F 1/00

[52] U.S. Cl. ..... 7/151; 7/118; 7/156; 81/3.09; 81/3.4; 81/3.55; 206/37.2; 206/37.3; 206/37.4; 206/37.6; 206/234

[58] Field of Search ..... 70/456–459; 206/37.1–37.8, 206/38, 38.1, 234, 349–350, 372–378, 37, 822; D3/207–212; 7/118, 120, 138, 142, 151–153, 156, 158, 160, 162, 165; 81/3.09, 3.4, 3.55, 177.4, 490, 440

[56] References Cited

U.S. PATENT DOCUMENTS

| | | | |
|---|---|---|---|
| 2,306,970 | 12/1942 | MacPherson et al. | 206/37.4 X |
| 2,558,265 | 6/1951 | Mosch | 7/151 X |
| 2,637,994 | 5/1953 | Harrison, Jr. et al. | 70/456 R |
| 2,795,128 | 6/1957 | Ly | 206/37.4 X |
| 2,904,373 | 9/1959 | Dowdy et al. | 7/151 X |
| 3,600,729 | 8/1971 | Laughlin | 7/118 |
| 4,078,272 | 3/1978 | Mahon, III | 7/118 X |
| 4,414,865 | 11/1983 | Brooks et al. | 81/3.09 |
| 4,455,894 | 6/1984 | Roberts | 81/3.09 |
| 4,478,532 | 10/1984 | Puro | 30/155 X |
| 5,199,560 | 4/1993 | Lee et al. | 206/37.6 X |
| 5,215,190 | 6/1993 | Hoffpauir, Jr. | 206/37.8 X |

FOREIGN PATENT DOCUMENTS

| | | | |
|---|---|---|---|
| 3827536 | 11/1989 | Germany | 206/37.3 |

*Primary Examiner*—D. S. Meislin

*Attorney, Agent, or Firm*—Timothy J. Martin; Michael R. Henson

[57] ABSTRACT

A utensil is adapted to be held by a user and manipulated by the user's hand to operate on a workpiece. One feature of the utensil enables the user to gain mechanical advantage when locking and unlocking key-operated locking mechanisms by displacing a key from its stowed state to its extended state. Other features include a letter opener, a cap remover, and an abrasive element.

29 Claims, 6 Drawing Sheets

MULTI-PURPOSE HAND TOOL

FIELD OF INVENTION

The present invention relates to a utensil which is adapted to be held by a user and manipulated by the user's hand and to operate on a workpiece. More specifically, the present invention is directed to a utensil which is particularly useful by a person who has physically impaired hands so that the user can more easily turn keys in a key way of locking mechanisms, file fingernails and open various containers such as envelopes, aspirin bottles, medicine containers and snap-top beverage cans, etc.

BACKGROUND OF THE INVENTION

Many people suffer from impaired use of their hands. Impaired use of one's hand may be a result of an injury, disease or even old age. Impaired use of one's hands makes it difficult for a person to conduct routine daily tasks such as unlocking doors, filing a fingernail, opening mail, aspirin bottles and medicine containers.

When a person locks or unlocks a locking mechanism with a key, usually, a thumb and a forefinger of the person's hand is used to grasp the bow of the key and the user rotates his/her wrist to turn the key in the key way of the locking mechanism. The distance from the rotational centerline of the key extending perpendicularly therefrom to the end of the bow is the moment arm. A sufficient force is therefore necessary to be applied along the moment arm to effectuate turning the key disposed in the key way of the locking mechanism. The smallest force to be applied to the key would be at the very ends of the bow of the key along the moment arm. For some people with impaired use of the their hands, even the minimum force required to turn the key may be too great to turn the key without a tool which, in effect, lengthens the moment arm. Any tool which can double the moment arm would, of course, decrease the amount of force required to turn the key disposed in the key way by one half (½).

Some people with impaired use of their hands find it difficult to remove caps from modern medicine containers. Laws have been promulgated which require the caps of modern medicine containers to be "child proof". Child proofing a medicine container has made it more difficult to open. Although the degree of difficulty is rather insignificant for one having normal use of his hands, opening a medicine bottle by a person having impaired ability of his hands can be insurmountable. Typically, the cap must be compressed onto the top of the medicine container and then unscrewed therefrom. Again, the moment arm which extends from the center of rotation of the cap around the medicine container to the radial end of the cap can be rather small for a person suffering from impaired use of his hands.

Laws have also been promulgated to "child-proof" aspirin bottles. Typically, an arrow on the lid of the aspirin bottle must be aligned with the arrow on the aspirin bottle itself. A serrated diamond-shaped tab extends from the rim of the lid and is appropriately aligned for opening when the arrows are aligned. Applying a force to the tab substantially parallel with the radial center of the cap will cause the cap to pop open from the aspirin container. Again, although opening an aspirin container is now more difficult, it is usually no problem for one with ordinary use of his/her hands. However, it becomes extremely more difficult to open an aspirin container for one of impaired use of his/her hands.

It can be a challenge for a person with impaired use of his/her hands to open a sealed envelope. To overcome this problem, those having this handicap often use a letter opener, a knife or some other elongated object which facilitates this task.

Opening beverage cans poses yet another problem for a person having impaired use of his/her hands. The beverage cans, particularly aluminum cans, include a snap top lid that requires strong and nimble fingers to raise a key in order to depress a cap into the beverage can, thereby opening the same. Often, a physically handicapped person would obtain a lever device such a butter knife or a screw driver and employ the same to gain mechanical advantage to open such a beverage can.

Those with severe limited use of their hands also find it difficult to use a simple nail file or an emery board for maintaining their fingernails. Nail files and emery boards are typically flattened elongated structures which require a thumb and a forefinger to hold the same while in use. Those with severe limited use of their hands find it virtually impossible to manicure their nails using such a device.

Devices have been manufactured and marketed to people having physically impaired hands to make daily tasks easier to perform. For example, one such device is an apparatus having a pair of plateau structures which form a V-shaped channel. The apparatus is securely fastened to a support structure. A pair of serrated walls face into the V-shaped channel and operate to grip a lid on a jar or similar container. Once the lid is gripped by the serrated walls, the user can then apply torque to the jar using both hands in order to remove the lid from the jar. Other devices such as letter openers and bottle openers have been used to more easily perform daily tasks. However, few devices have been made which combine a variety of features onto a single, comport apparatus.

There is a need to provide physically handicapped people with a utensil that can assist them in turning keys in key ways of locking mechanisms. There is also a need to provide physically handicapped people with a utensil which can assist them with opening modern medicine containers as well as aspirin bottles. There is also a need to provide a utensil for physically handicapped people to assist them in opening sealed envelopes. There is a further need to provide physically handicapped people with a device which could assist them in opening beverage cans. Another need is to provide physically handicapped people with a utensil that would be easy to grip for the purpose of manicuring their nails. It would be advantageous if all of the utilitarian features needed by physically handicapped people could be combined in a single utensil. It would also be advantageous if such a utensil could be easily gripped and manipulated by hand of one having impaired use of his/her hands. The present invention satisfies these needs and offers these advantages.

SUMMARY OF INVENTION

It is an object of the present invention to provide a new and useful utensil which is adapted to be held and manipulated by a human hand to gain mechanical advantage when using the same.

It is another object of the present invention to provide a utensil which includes a variety of features to assist a person in turning keys and key ways, opening letters, medicine containers, aspirin containers and beverage cans and filing fingernails.

It is yet another object of the present invention to provide a utensil that is adapted to employ a plurality of tool elements of various types depending upon the needs of the user.

A still further object of the present invention is to provide a utensil for a person having impaired use of his/her hands to facilitate turning a key in a key way to lock and unlock locking mechanism.

Still another object of the present invention is to provide a utensil for a person having impaired use of his/her hands to facilitate opening letters, aspirin bottles, medicine containers and beverage cans.

Still yet another object of the present invention is to provide a utensil for a person having physically impaired use of his/her hands to facilitate filing fingernails.

Another object of the present invention is to provide a utensil for a person having impaired use of his/her hands which can be easily gripped, picked up and manipulated.

A still further object of the present invention is to provide a utensil which can employ a variety of tool elements.

Another object of the present invention is to provide a utensil having a plurality of tool elements which can be easily moved between a stowed state and an extended state.

Yet another object of the present invention is to provide a utensil which is adapted to receive a conventional key ring.

Yet another object of the present invention is to provide a utensil which is lightweight and can be releasably connected to any metal-based appliance such as a refrigerator by a magnet.

Accordingly, the present invention provides a utensil that is adapted to be held by a user and manipulated by the user's hand and operative to act on a workpiece as hereinafter described. In its broadest form, the utensil includes a body member and a rigid first tool element. The body member has flat first and second surfaces which are spaced apart from one another along a central axis. The body member includes a peripheral edge which extends therearound and has a thickness between the first and second surfaces. The body member has at least a first cavity formed into the peripheral edge between the first and second surfaces. The tool element is sized and adapted to be received in a closely-fitted relationship by the first cavity so that the first tool element can move between a stowed state and an extended state. In the stowed state, the first tool element is disposed within the first cavity. In the extended state, a proximal end portion of the first tool element is disposed within the first cavity while a distal end portion of the first tool element extends exteriorly of the first cavity. The body member may be manipulated to act on the proximal end portion of the first tool element thereby gaining mechanical advantage on the distal end portion of the first tool element.

It is preferred that the utensil include multiple tool elements. By way of example only, any of the tool elements can be a key, a knife blade, a screw driver and a letter opener assembly. When multiple tool elements are employed, multiple cavities are formed into the utensil. The multiple cavities are spaced apart from one another. Respective ones of the tools are pivotally disposed on a respective one of a plurality of pins which extend through respective cavities between the first and second surfaces. The tool elements can be force fitted onto a respective pin or friction elements can be used so that the tool elements can frictionally resist movement when the tool element is disposed in either the stowed state or the extended state. Fingerholes are formed into either the first surface or the second surface. The fingerhole is in communication with the cavities and are operative to provide access to the tool elements so that the tool elements can be moved into the extended state by a finger of the user.

A pair of plateau structures are disposed on either the first surface or the second surface and are oriented relative to each other to form a substantially V-shaped channel therebetween. The V-shaped channel is located above either the first or second surface. Each of the plateau structures includes an inner wall facing into the V-shaped channel. Each of the inner walls has a plurality of serrations which extend parallel to the central axis. A surface recess is formed into one of the first and second surfaces and is operative, for example, to pry a lid from an aspirin bottle. A peripheral recess is formed into the peripheral edge of the body member and is operative, for example, to receive and bend a snap-top lid of a beverage can in order to open the same. To enhance the grip of the user onto the utensil, at least a portion of the peripheral edge includes a plurality of ridges that extend parallel to the central axis.

Although the utensil can be fabricated of a one-piece unitary plastic construction, it is preferred that the utensil is a two-piece plastic construction. Although it is preferred that the utensil be configured generally in the shape of a circle, the utensil can also be configured in a shape of a triangle or an oval. The utensil also includes a tab that extends outwardly from the peripheral edge. The tab has a hole formed therethrough. The hole is sized and adapted to receive a ring such as a key ring.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

A utensil of the present invention is adapted to be held by a user and manipulated by the user's hand. The utensil of the present invention is particularly suitable for users who suffer from an impaired ability to use their hands. The utensil provides many features so that the user can more easily perform a variety of tasks which are otherwise difficult to perform. One feature of the utensil enables the user to gain mechanical advantage when locking and unlocking key-operated locking mechanisms. A key is easily displaced from its stowed state to its extended state by a finger hole formed in a flat surface of the utensil. Another feature affords the user to easily move a letter opener assembly from its stowed state to its extended state. In its extended state, the letter opener assembly is easily guided through a sealed envelope by gripping a body member of the utensil as a handle. Other features of the utensil of the present invention enable the user to easily remove caps from conventional medicine containers and conventional aspirin bottles and to open beverage cans having snap-top lids. Also, the utensil includes an abrasive element, a magnetic element and a ring. The abrasive element can be used for filing. The magnetic element can be used to conveniently retain the utensil on, for example, a refrigerator door. The ring can be used to retain additional keys on the utensil.

Figure 2:
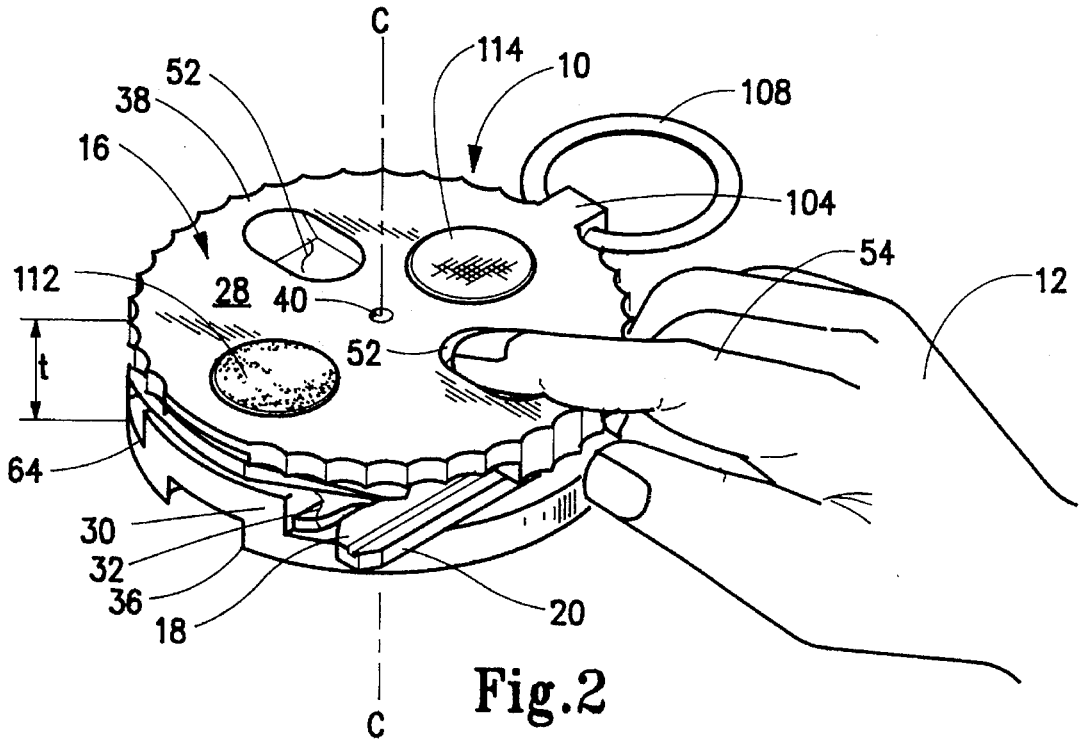
FIG. 2 is a reverse perspective view of the utensil shown in FIG. 1 and illustrating a user's finger moving one of the keys from its stowed state to its extended state.
Figure 3:
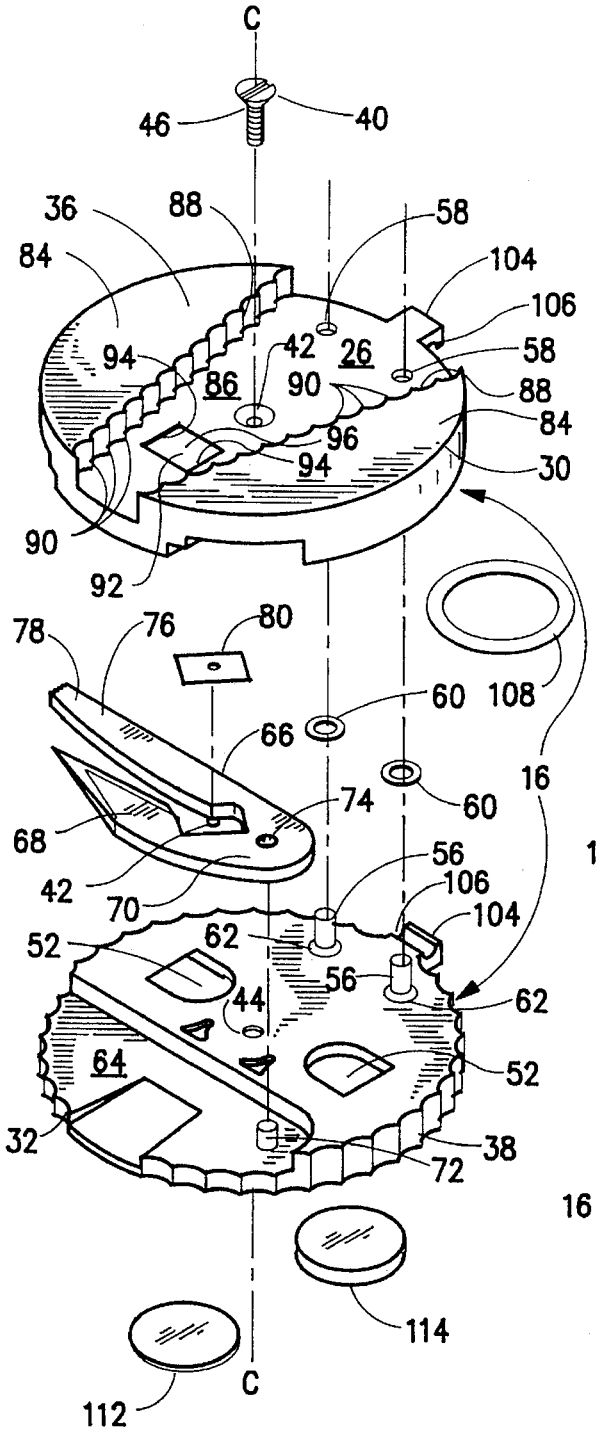
FIG. 3 is an exploded perspective view of the utensil of the present invention shown in FIG. 1.
Figure 4:
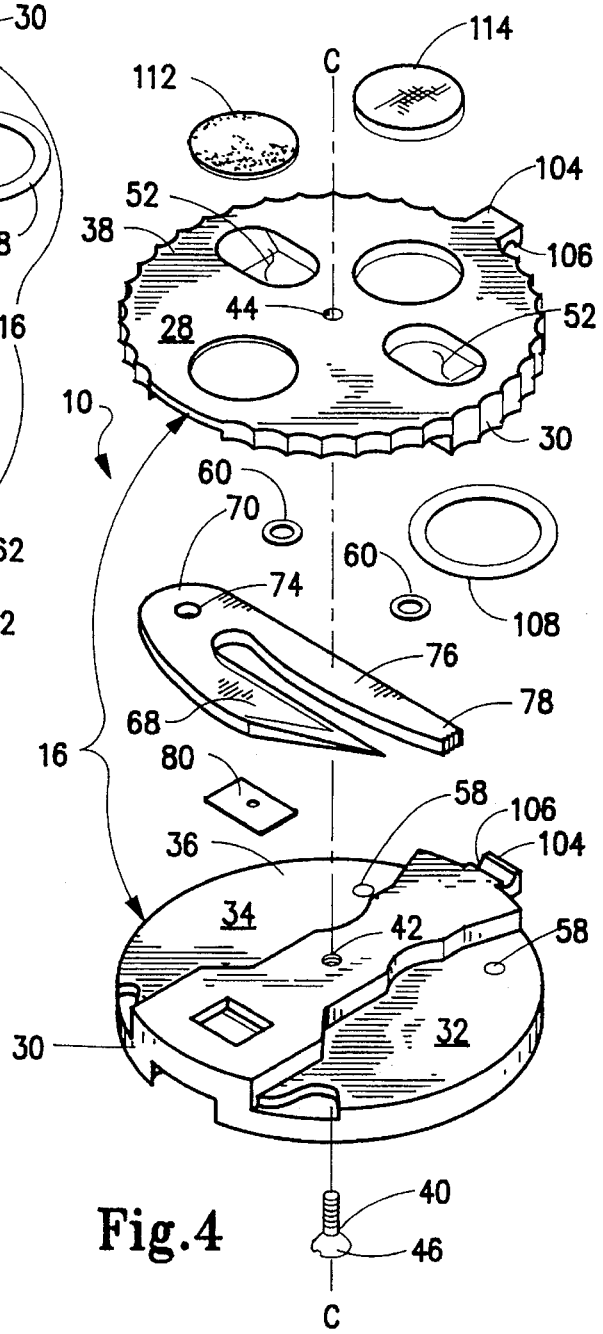
FIG. 4 is an exploded perspective view of the utensil shown in FIG. 2.

A first exemplary embodiment of utensil 10 of the present invention is introduced in FIGS. 1–9. Utensil 10 is adapted to be held by a user and manipulated by a user's hand or hands 12. Utensil 10 is operative to act on a workpiece 14. Utensil 10 includes a body member 16, a rigid first tool element 18 in the form of a first key 20 and a rigid second tool element in the form of a second key 24. Body member 16 has a flat first surface 26 and a flat second surface 28 which are spaced apart along a central axis "c". Body member 16 includes a peripheral edge 30 which extends around body member 16 and has a thickness "t" between first and second surfaces 26 and 28. Although not by way of limitation, body member 16 has at least a first cavity 32 and a second cavity 34 which are formed into peripheral edge 30 between first and second surfaces 26 and 28 and spaced apart from one another as best shown in FIG. 4.

Body member 16 is configured in a shape of a circle and is of a two-piece plastic construction. With reference to FIGS. 3 and 4, body member 16 includes a first body member piece 36 and a second body member piece 38. First body member piece 36 and second body member piece 38 are releasably connected to each other by a screw 40. As best shown in FIGS. 3 and 4 a countersunk hole 42 formed in first body member piece 36 and a threaded hole 44 formed in second body member piece 38 are axially aligned along central axis "c". Countersunk hole 42 enables a flat tapered head 46 of screw 40 to be received in a manner so that flat tapered head 46 is flush with first surface 26 when first and second body member pieces 36 and 38 are releasably connected to each other.

Figure 1:
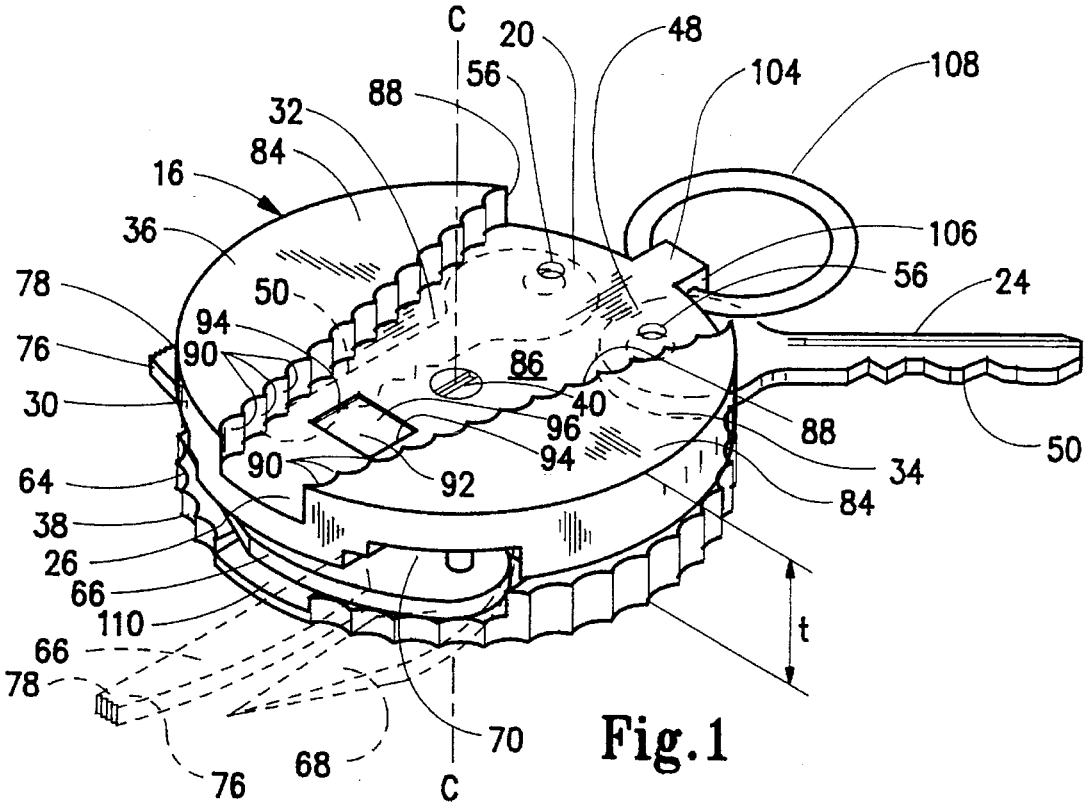
FIG. 1 is perspective view of a first embodiment of a utensil of the present invention with a pair of keys, one in the extended state and the other in a stowed state and a knife structure in a knife stowed state and drawn phantomly in a knife extended state.

Each of first and second keys 20 and 24 is sized and adapted to be received in a closely-fitted relationship by respective first and second cavities 32 and 34 so that each key 20 and 24 can move between a stowed state and an extended state. In the stowed state, respective ones of first and second keys 20 and 24 are disposed within respective ones of first and second cavities 32 and 34. As best shown in FIG. 1, in the extended state, a respective bow end portion 48 of each key 20 and 24 is disposed within a respective one of first and second cavities 32 and 34 while a respective blade end portion 50 of each key 20 and 24 extends exteriorly of a respective one of first and second cavities 32 and 34 so that body member 16 may be manipulated to act on respective bow end portions 48 of each key 20 and 24 to gain mechanical advantage of respective ones of blade end portions 50. With reference to FIGS. 2 and 4, second surface 28 includes a pair of finger holes 52 formed thereinto. Each finger hole 52 is in communication with a respective one of first and second cavities 32 and 34 and is operative to provide access to respective ones of keys 20 and 24 disposed in first and second cavities 32 and 34 in the stowed state so that keys 20 and 24 can be moved into the extended state by a finger 54 of the user.

As best shown in FIGS. 1 and 3, utensil 10 includes a pair of pins 56. Each pin 56 extends through a respective one of first and second cavities 32 and 34 between first and second surfaces 26 and 28 and into a respective one of a pair of pin holes 58. A respective one of keys 20 and 24 is pivotally disposed on a respective one of pins 56.

As best illustrated in FIG. 3, utensil 10 includes a pair of friction elements 60 which are associated with respective ones of each of first and second cavities 32 and 34 and keys 20 and 24. The pair of friction elements 60 are operative to frictionally resist movement of respective ones of keys 20 and 24 when disposed in one of the stowed state and the extended state so that each key 20 and 24 tends to remain in either the stowed state or the extended state when moved thereto. Each of friction elements 60 is slidably received by a respective one of pins 56 and are operative to apply a frictional force against bow end portion 48 of respective ones of keys 20 and 24. For the first embodiment of utensil 10 of the present invention, o-rings have been selected as friction elements 60. An annular groove 62 is formed into second body member piece 38 concentrically around each pin 56. Each annular groove 62 is sized and adapted to partially receive a respective one of the o-rings.

In FIGS. 1 and 3, utensil 10 is shown to include a third cavity 64 and a knife structure 66. Third cavity 64 is formed into peripheral edge 30 between first and second surfaces 26 and 28 and is spaced apart from first and second cavities 32 and 34. Knife structure 66 is operative to move between a knife stowed state and a knife extended state. In the knife stowed state, knife structure 66 is disposed within third cavity 64. In the knife extended state, a free knife end portion 68 of knife structure 66 extends exteriorly of third cavity 64 while a proximal knife end portion 70 remains within third cavity 64. Proximal knife end portion 70 of knife structure 66 pivots about a third pin 72 which extends between first and second surfaces 26 and 28 as shown in FIG. 3. Proximal knife end portion 70 of knife structure 66 includes a pivot hole 74 which extends therethrough so that third pin 72 can be force-fitted thereunto thus causing a resistive force resisting movement of knife structure 66 when moved between the knife stowed state and the knife extended state.

With reference to FIGS. 1, 3, 4 and 7, knife structure 66 includes an arm member 76 which is connected to proximal knife end portion 70. Arm member 76 extends from proximal knife end portion 70 and outwardly of third cavity 64 and beyond peripheral edge 30 to terminate in an arm end 78 when knife structure 66 is in the stowed state. An opening force "o" as shown in FIG. 1 applied to arm end 78 moves knife structure 66 from the knife stowed state to the knife extended state.

Knife structure 66 includes a blade element 80 which is connected thereto on both free knife end portion 68 and proximal knife end portion 70. It is preferred that blade member 80 is connected to knife structure 66 by a rivet 82. One of ordinary skill in the art would appreciate that knife structure 66 as described hereinabove forms a letter opener assembly.

Again referring to FIGS. 1 and 3, utensil 10 includes a pair of plateau structures 84 that extend from first surface 26 and are oriented to define a substantially V-shaped channel 86 between plateau structures 84. Each of plateau structures 84 includes an inner wall 88 facing into V-shaped channel 86. Each inner wall 88 has a plurality of serrations 90 which extend parallel to central axis "c".

Figure 5:
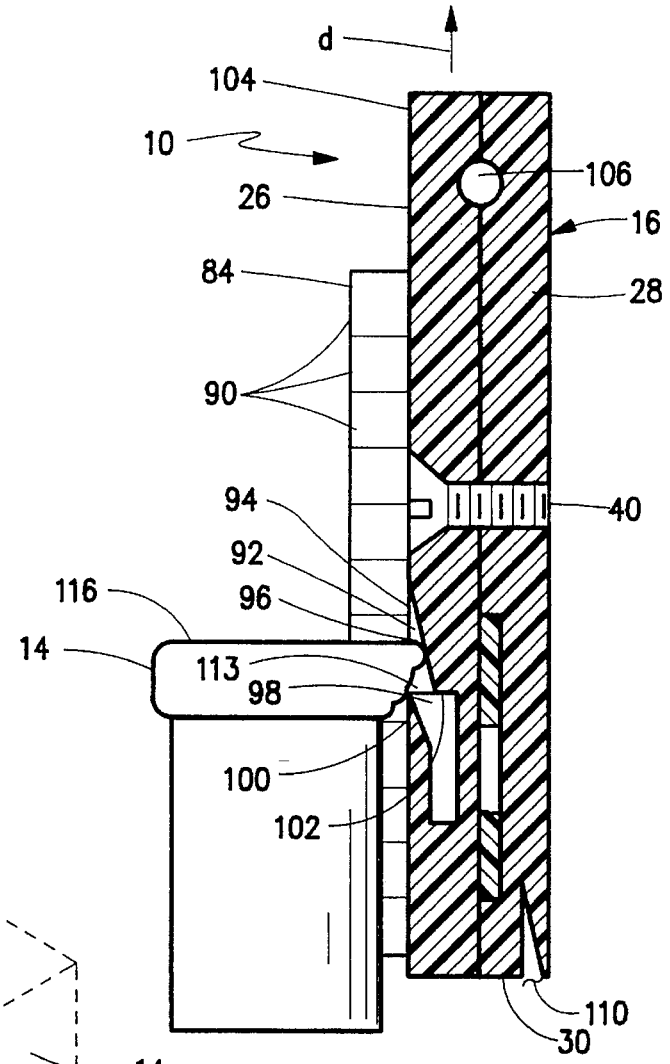
FIG. 5 is a side view in cross-section of the utensil of the present invention illustrating how to employ the utensil when removing a cap from a conventional aspirin container.

Additionally, first surface 26 includes a surface recess 92 which is formed thereinto as best shown in FIGS. 1, 3 and 5. Surface recess 92 is defined by a pair of oppositely-disposed triangularly-shaped sidewalls 94 and a ramping wall 96 which extends therebetween. An opening 98 is formed between an upper edge 100 of first surface 26 and a lower edge portion 102 of ramping wall 96 and between triangularly-shaped sidewalls 94.

Utensil 10 also includes a tab 104 that extends outwardly from peripheral edge 30. Tab 104 has a hole 106 that is formed therethrough. Hole 106 is sized and adapted to receive a ring 108. Ring 108 can be a one piece unitary construction which is received by hole 106 before releasably connection first body member 36 to second body member piece 38. However, it is preferred that ring 108 is a split ring type so that other items as additional keys can be secured to the ring without disconnecting first body member piece 36 and second body member piece 38.

In FIGS. 1 and 5, a peripheral recess 110 is formed into peripheral edge 30 of body member 16. Peripheral recess 110 tapers inwardly from peripheral edge 30.

Utensil 10 also includes an abrasive element 112 and a magnetic element 114. Although abrasive element 112 can be connected to either one of first and second surfaces 26 and 28, it is preferred that abrasive element 112 is connected to second surface 28. Although magnetic element 114 can be connected to either one of first and second surfaces 26 and 28, it is preferred that magnetic element 114 is connected to second surface 28.

Many of the features of utensil 10 of the present invention yield advantages and benefits to the user as generally illustrated in FIGS. 5–9. In FIG. 5, utensil 10 is employed to act on workpiece 14 which is a conventional aspirin container. Aspirin container has a lid 116 with a serrated lip 118. Serrated lip 118 is engaged with surface recess 92 as shown in FIG. 5. While serrated lip 118 is engaged with surface recess 92, utensil 10 is moved in a direction "d" in order to pry lid 116 from its on state to its off state.

Figure 6:
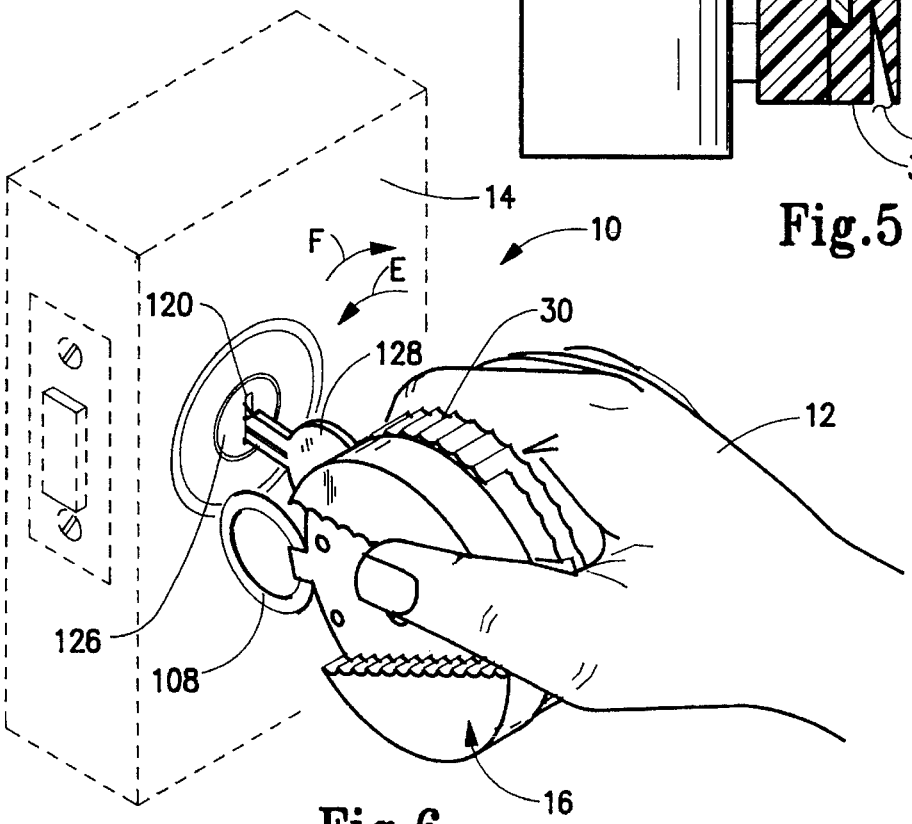
FIG. 6 is a perspective view of the utensil of the present invention with one key in its extended state depicting how the utensil is used to turn the key in a locking structure.

In FIG. 6, user's hand 12 grips utensil 10 that has a key in the extended state and disposed within a key way 120 of a locking mechanism 122. Rotating body member 15 in either direction "e" or direction "f" causes body member 16 to act on proximal end portion 124 of the key to gain mechanical advantage on a distal end portion 126 of the key. Thus, by virtue of mechanical advantage, rotating the key in key way 120 is easier than if the proximal end portion 124 was gripped by hand 12.

Figure 7:
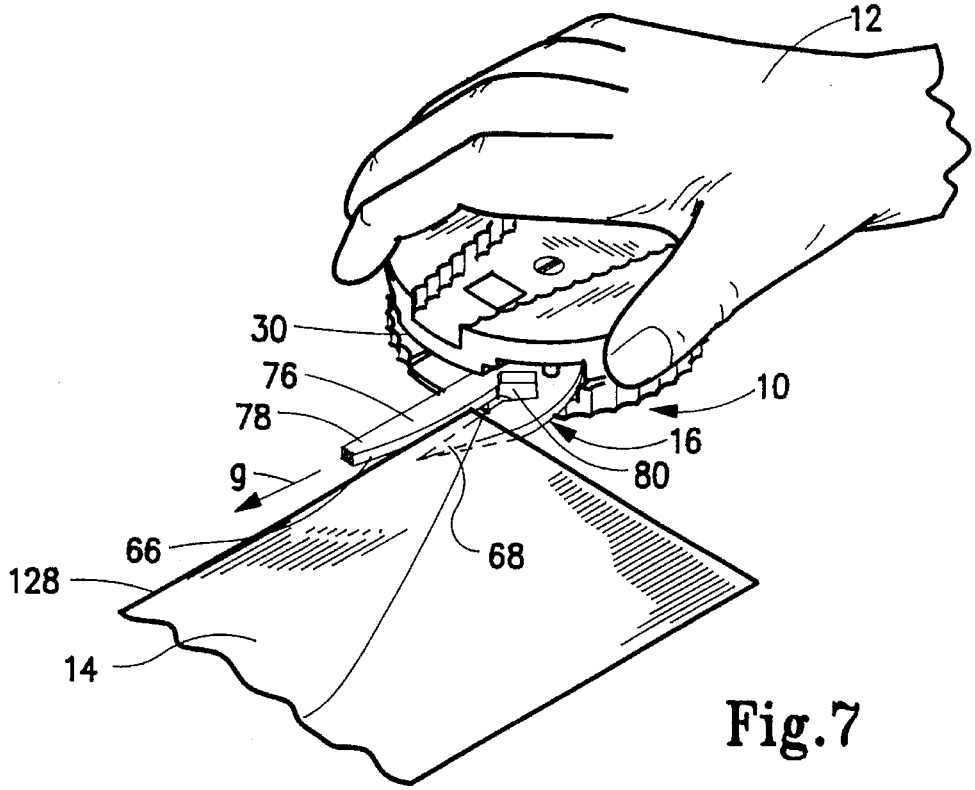
FIG. 7 is a perspective view of the utensil of the present invention with the knife structure in its knife extended state demonstrating how to open a conventional envelope.

In FIG. 7, utensil 10 having knife structure 66 disposed in the extended state is employed to open workpiece 14 which is a conventional envelope. Free knife end portion 68 is inserted into the envelope until a fold 128 of the envelope contacts blade member 80. With the user's hand 12 gripping body member 16 in the matter shown, utensil 10 is advanced in direction "g" to open the envelope.

Figure 8:
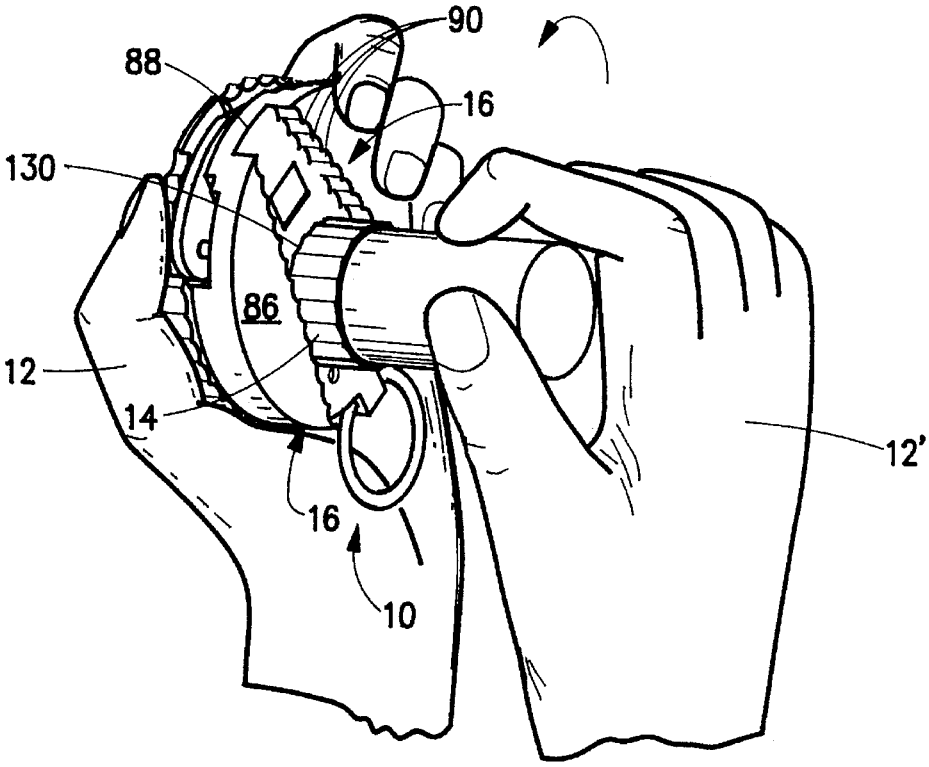
FIG. 8 is a perspective view of the utensil of the present invention demonstrating how to employ the utensil for removing a cap from a convention medicine container.
Figure 9:
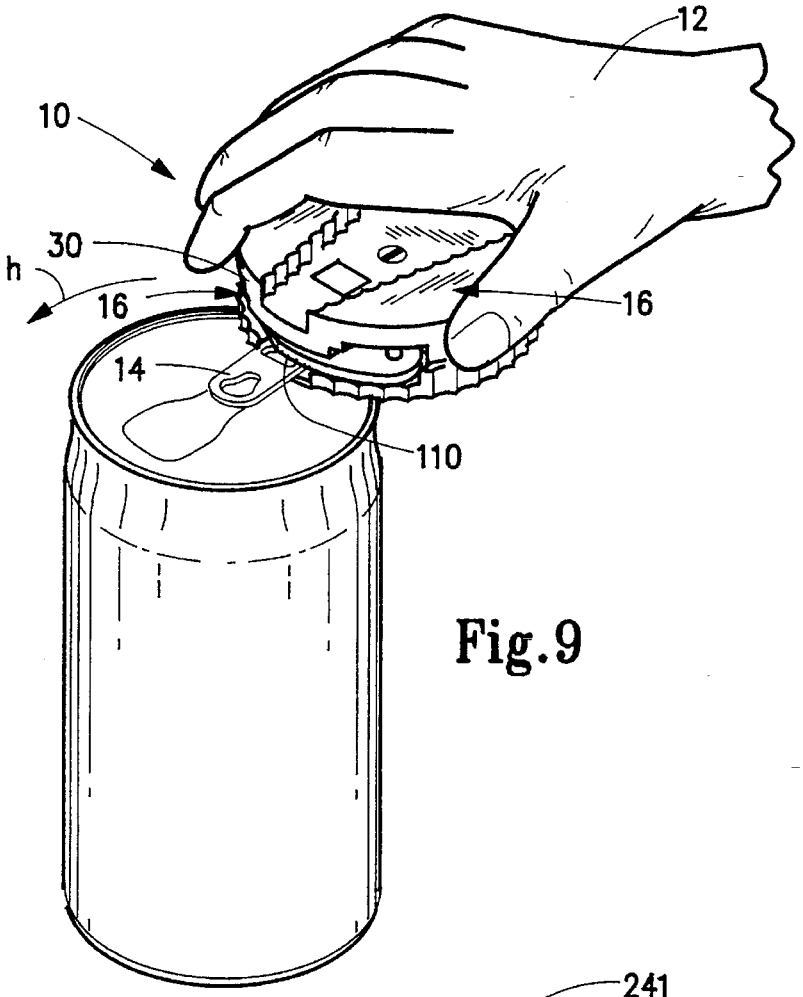
FIG. 9 is a perspective view of the utensil of the present invention illustrating how to open a beverage container having a conventional snap-open lid.

In FIG. 8, a user's left hand 12 grips body member 16 while the user's right hand 12' grips a workpiece 14 in the form of a conventional medicine container. A medicine container lid 130 is disposed within V-shaped channel 86 and urged against the pair of inner walls 88 having serrations 90. After compressing the medicine container and utensil 10 together, the respective user's hands are rotated in opposite directions to untwist medicine container lid 130 from the medicine container. FIG. 9 illustrates how the user opens a beverage can having a snap-top lid which is shown as workpiece 14. A lever member 132 of the snap-lid is received by peripheral recess 110. The user's hand 12 rotates in a direction "h" to open the beverage can.

Figure 10:
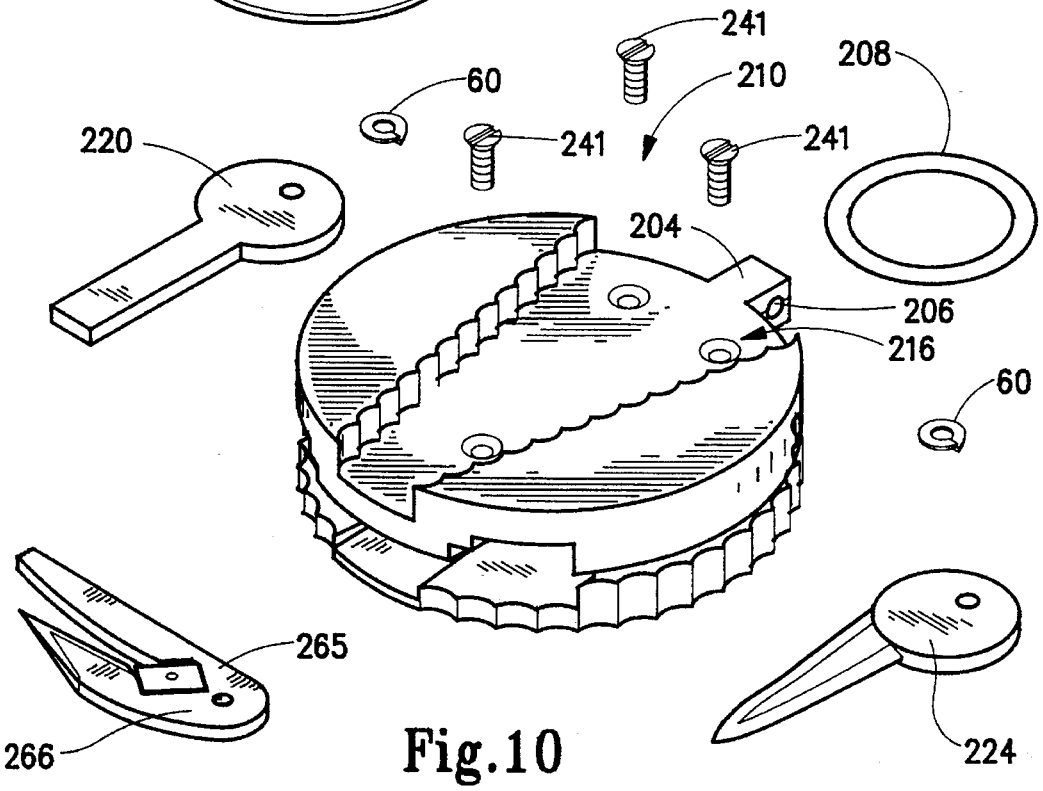
FIG. 10 is an exploded perspective view of a second exemplary embodiment of the present invention employing alternative tool elements such as a screw driver and a knife.

A second exemplary embodiment of a utensil 210 is depicted in FIG. 10. Utensil 210 includes a body member 216 which is of a unitary one-piece plastic construction. Utensil 210 also includes a first tool element in the form of a screwdriver 220 and a second tool element in the form of a knife blade 224. A third tool element 265 is a knife structure 266. One of ordinary skill in the art would appreciate that the first tool element, the second tool element and the third tool element are selected from a group consisting of a key, a knife blade, a screwdriver and a letter knife structure 266 which can also be a letter opener assembly. At least one of the first tool element, the second tool element and third tool element is selected from a group different from the groups selected for the remaining ones of the tool elements. Therefore, any type of tool element in any combination thereof can be employed with the utensil of the present invention without the departing from the inventive concepts herein. Furthermore, the tool elements described herein are offered by way of example only. A skilled artisan would appreciate that a wide variety of tool elements including but not limited to a pick or a file can also be employed without departing from the spirit of the present invention. A plurality of set screws 241 are employed so that the tool elements can pivot thereabout. Also, in lieu of o-rings such as friction element 60, spring washers may be used. To facilitate ease of assembly, it is preferred that a split ring 208 is connected to tab 204 through hole 206.

Figure 11:
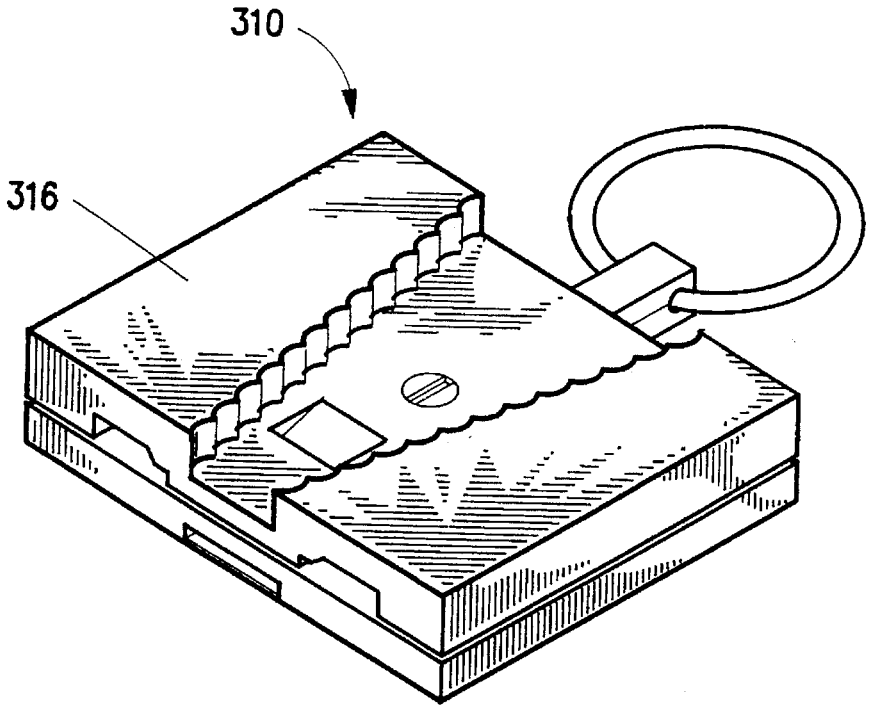
FIG. 11 is a perspective view of a third exemplary embodiment of a utensil of the present invention showing a rectangularly shaped body member.

A third exemplary embodiment of a utensil 310 of the present invention is shown in FIG. 11. Although utensil 310 includes all of the features and advantages of the present invention as described hereinabove, the only difference is that body member 316 is configured in a shape of a rectangle.

Figure 12:
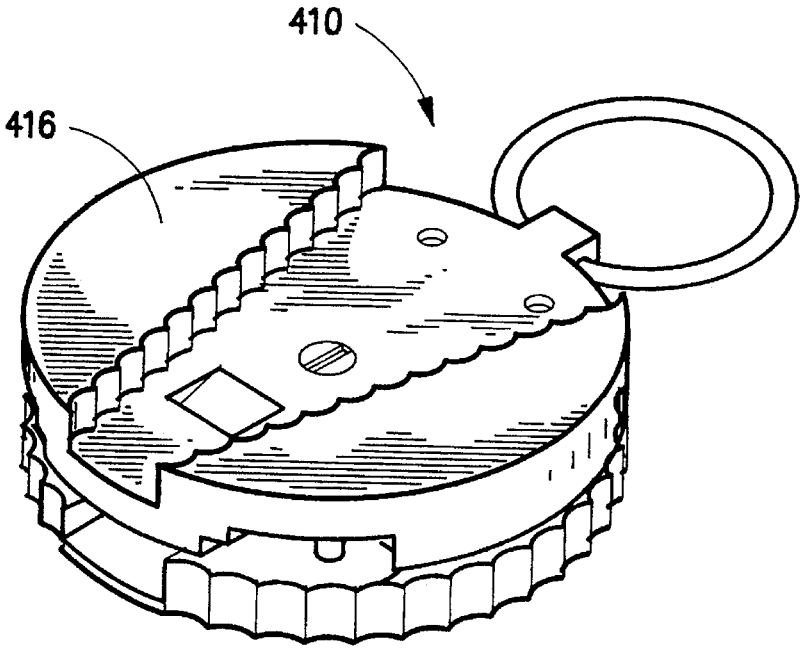
FIG. 12 is a perspective view of a fourth exemplary embodiment of a utensil of the present invention having an oval-shaped configuration.

A fourth exemplary embodiment of a utensil 410 is shown in FIG. 12 with all of the features and advantages of the present invention as described hereinabove. The only difference is that utensil 410 has a body member configured in a shape of an oval. A skilled artisan would appreciate that the body member of the utensil can be configured in a variety of shapes without departing from the spirit of the invention.

As described, the present invention affords numerous advantages and benefits to the user. The advantages and benefits are particularly important to a user who suffers from impaired ability of the use of his/her hands. By employing the utensil of the present invention, the user can now easily turn keys in key ways of locking mechanisms, file fingernails and open items such as letters, medicine containers, aspirin containers and beverage cans. Also, the magnetic element of the present invention can be used not only to retain the utensil on a metal based kitchen appliance but also to pick up small metallic items such as safety pins and paper clips. This magnetic feature could be valuable to a person who suffers from an impaired ability to use his/her hands. Further the tool elements can be stowed within separate cavities formed into the body member and can be easily removed therefrom even by a person who suffers from an impairment to use of his/her hands. Virtually any type of tool element that requires a handle for leverage cans be employed with the present invention.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A utensil adapted to be held by a user and manipulated by the user's hand and operative to act on a workpiece, comprising:

(a) a body member having flat first and second surfaces spaced apart from one another along a central axis, said body member including a peripheral edge extending therearound and having a thickness between said first and second surfaces, said body member having at least a first cavity formed into said peripheral edge between said first and second surfaces.

(b) a rigid first tool element sized and adapted to a received in a closely-fitted relationship by said first cap it so that said first tool element can move between a stowed state whereby said first tool element is disposed within said first cavity and an extended state whereby a proximal end portion of said first tool element is disposed within said first cavity while a distal end portion of said first tool element extends exteriorly of said first cavity so that said body member may be manipulated to act on said proximal end portion of said first tool element thereby to gain mechanical advantage on said distal end portion; and (c) a peripheral recess formed into said peripheral edge of said body member, said peripheral recess tapering inwardly from said peripheral edge.

2. A utensil according to claim 1 wherein one of said first and second surfaces includes at least one finger hole formed thereinto, said finger hole being in communication with said first cavity and operative to provide access to said first tool element disposed in said first cavity in the stowed state so that said first tool element can be moved into the extended state by a finger of the user.

3. A utensil according to claim 2 including a pin extending through said first cavity between said first and second surfaces, said first tool element being pivotally disposed on said pin.

4. A utensil according to claim 1 including a friction element associated with said first cavity and said first tool element and operative to frictionally resist movement of said first tool element when said first tool element is disposed in one of the stowed state and the extended state.

5. A utensil according to claim 1 including a second cavity formed into said peripheral edge between said first and second surfaces and spaced apart from said first cavity and including a rigid second tool element sized and adapted to be received in a closely-fitted relationship by said second cavity so that said second tool element can move between the stowed state and the extended state within said second cavity.

6. A utensil according to claim 5 including a third cavity formed into said peripheral edge between said first and second surfaces and spaced apart from said first and second cavities and including a rigid third tool element sized and adapted to be received in a closely-fitted relationship by said third cavity so that said third tool element can move between the stowed state and the extended state within said third cavity.

7. A utensil according to claim 6 wherein said first tool element, said second tool element and said third tool element are selected from a group consisting of a key, a knife blade, a screw driver and a letter opener assembly.

8. A utensil according to claim 7 wherein at least one of said first tool element, said second tool element and said third tool element is selected from a group different from the groups selected for remaining ones of said tool elements.

9. A utensil according to claim 1 wherein one of said first and second surfaces includes a surface recess formed thereinto.

10. A utensil according to claim 9 wherein said recess is defined by a pair of oppositely-disposed triangularly-shaped sidewalls and a ramping wall extending therebetween whereby an opening is formed between an upper edge of said one of said first and second surfaces and a lower edge portion of said ramping wall and between said triangularly-shaped sidewalls.

11. A utensil according to claim 1 including an abrasive element connected to one of said first and second surfaces.

12. A utensil according to claim 1 including a magnetic element connected to one of said first and second surfaces.

13. A utensil according to claim 1 including a tab connected to and extending outwardly from said peripheral edge, said tab having a hole formed therethrough.

14. A utensil according to claim 1 wherein said body member is of a unitary one-piece plastic construction.

15. A utensil according to claim 1 wherein said body member is of a two-piece plastic construction whereby said body member includes a first body member piece and a second body member piece, said first and second body member pieces being releasably connected to each other.

16. A utensil according to claim 1 wherein said body member is configured in a shape selected from a group consisting of a circle, a rectangle and an oval.

17. A utensil according to claim 1 wherein said tool element is selected from a group consisting of a key, a knife blade, a screw driver and a letter opener assembly.

18. A utensil according to claim 1 wherein at least a portion of said peripheral edge includes a plurality of ridges extending parallel to said central axis.

19. A utensil adapted to be held by a user and manipulated by the user's hand to act on a workpiece, comprising:

(a) a body member having flat first and second surfaces spaced apart along a central axis, said body member including a peripheral edge extending therearound and having a thickness between said first and second surfaces, said body member having at least a first and a second cavity formed into said peripheral edge between said first and second surfaces spaced apart from one another;

(b) a first key;

(c) a second key, each of said first and second keys being sized and adapted to be received in a closely-fitted relationship by a respective one of said first and second cavities so that each key can move between a stowed state whereby respective ones of said first and second keys are disposed within respective ones of said first and second cavities and an extended state whereby a respective bow end portion of each key is disposed within a respective one of said first and second cavities while a respective blade end portion of each key extends exteriorly of a respective one of said first and second cavities so that said body member may be manipulated to act on said respective bow end portions of each key thereby to gain mechanical advantage on respective ones of said blade end portions thereof; and (d) a surface recess formed into said first surface, said surface recess defined by a pair of oppositely-disposed triangularly-shaped sidewalls and a ramping wall extending therebetween whereby an opening is formed between an upper edge of said first surface and a lower edge portion of said ramping wall and between said triangularly-shaped sidewalls.

20. A utensil according to claim 19 wherein said second surface includes a pair of finger holes formed thereinto, each finger hole being in communication with a respective one of said first and second cavities and operative to provide access to respective ones of said keys disposed in said first and second cavities in the stowed state so that said keys can be moved into the extended state by a finger of the user.

21. A utensil according to claim 20 including a pair of pins, each pin extending through a respective one of said first and second cavities between said first and second surfaces, a respective one of said keys being pivotally disposed on a respective one of said pins.

22. A utensil according to claim 21 including a friction element associated with respective ones of each of said cavities and said keys and operative to frictionally resist movement of respective ones of said keys when disposed in one of the stowed state and the extended state.

23. A utensil according to claim 19 including a third cavity formed into said peripheral edge between said first and second surfaces and spaced apart from said first and second cavities and including a knife structure operative to move between a knife stowed state whereby said knife structure is disposed within said third cavity and a knife extended state whereby a free knife end portion of said knife structure extends exteriorly of said third cavity while a proximal knife end portion remains within said third cavity, said proximal knife end portion of said knife structure pivots about a third pin extending between said first and second surfaces.

24. A utensil according to claim 23 wherein said proximal knife end portion of said knife structure includes a pivot hole extending therethrough so that said third pin can be force-fitted thereonto thereby causing a resistive force resisting movement of said knife structure when moved between the knife stowed state and the knife extended state.

25. A utensil according to claim 24 wherein said knife structure includes an arm member connected to said proximal knife end portion and extending therefrom outwardly of said third cavity and beyond said peripheral edge to terminate in an arm end so that an opening force can be applied to said arm end to move said knife structure from the knife stowed state to the knife extended state.

26. A utensil according to claim 19 including a pair of plateau structures extending from said surface and oriented to define a substantially V-shaped channel between said plateau structures, each of said plateau structures includes an inner wall facing into said V-shaped channel, each of said inner walls having a plurality of serrations extending parallel to said central axis.

27. A utensil according to claim 19 including a tab extending outwardly from said peripheral edge, said tab has a hole formed therethrough, said hole sized and adapted to receive a ring.

28. A utensil adapted to be held by a user and manipulated by the user's hand and operative to act on a workpiece, comprising:

(a) a body member having flat first and second surfaces spaced apart from one another along a central axis, said body member including a peripheral edge extending therearound and having a thickness between said first and second surfaces, said body member having at least a first cavity formed into said peripheral edge between said first and second surfaces;

(b) a rigid first tool element sized and adapted to be received in a closely-fitted relationship by said first cavity so that said first tool element can move between a stowed state whereby said first tool element is disposed within said first cavity and an extended state whereby a proximal end portion of said first tool element is disposed within said first cavity while a distal end portion of said first tool element extends exteriorly of said first cavity so that said body member may be manipulated to act on said proximal end portion of said first tool element thereby to gain mechanical advantage on said distal end portion thereof; and (c) a pair of plateau structures disposed on one of said first and second surfaces and oriented relative to each other to form a substantially V-shaped channel therebetween, said V-shaped channel being located above one of said first and second surfaces.

29. A utensil according to claim 28 wherein each of said plateau structures includes an inner wall facing into said V-shaped channel, each of said inner walls having a plurality of serrations extending parallel to said central axis.

* * * * *